United States Patent [19]

Mannheim

[11] 4,106,135

[45] Aug. 15, 1978

[54] WATER CLOSET BASIN ASSEMBLY

[75] Inventor: Daniel I. Mannheim, Corona, N.Y.

[73] Assignee: Lawrence Peska Associates, Inc., New York, N.Y.

[21] Appl. No.: 828,985

[22] Filed: Aug. 30, 1977

[51] Int. Cl.[2] ..... A47K 13/18

[52] U.S. Cl. ..... 4/247; 4/242

[58] Field of Search ..... 4/247, 242, 243, 244, 4/246, 247, 222, 234; 242/57

[56] References Cited

U.S. PATENT DOCUMENTS

| | | | |
|---|---|---|---|
| 1,296,220 | 3/1919 | Rigby | 4/247 |
| 1,435,685 | 11/1922 | Bangen | 4/247 |
| 1,867,506 | 7/1932 | Grypma et al. | 4/247 |
| 2,002,948 | 5/1935 | Joniot | 4/247 |
| 2,024,088 | 12/1935 | Benson | 4/247 |
| 2,079,975 | 5/1937 | Volkmann et al. | 4/247 |
| 2,123,012 | 7/1938 | Krautzig | 4/247 |
| 2,243,134 | 5/1941 | Stiller | 4/247 |
| 2,342,048 | 2/1944 | Halfin | 4/247 X |
| 2,987,732 | 6/1961 | Speese | 4/247 |
| 3,271,792 | 9/1966 | Tromp | 4/247 |

*Primary Examiner*—Henry K. Artis

[57] ABSTRACT

Water closet basin assembly comprising a basin having an upper edge, a basin seat adapted to overlie the basin edge, a bracket fixed to the basin edge and having an elastomeric portion for disposition between the edge and the seat, and dispenser means proximate said basin and operative to dispense paper suitable for disposition overlying the seat, dispensing of the paper being responsive to change in pressure exerted on said seat and thereby said elastomeric portion.

10 Claims, 2 Drawing Figures

WATER CLOSET BASIN ASSEMBLY

BACKGROUND OF THE INVENTION

1. Field of the Invention

This invention relates to water closet basins and is directed more particularly to a water closet basin assembly including dispensing means for paper suitable for covering the seat of the basin.

2. Description of the Prior Art

Several designs have been put forward for devices whose object is to provide paper, or the like, suitable for covering the seat of a water closet basin. Examples of such devices may be found in U.S. Pat. Nos. 1,296,220 issued Mar. 4, 1919, to C. Rigby; 1,452,552 issued Apr. 24, 1923, to L. J. Frear; 1,765,463 issued June 24, 1930, to T. Strumpf; 1,843,778 issued Feb. 2, 1932, to A. I. McColl; 1,858,794 issued May 17, 1932, to E. Vallecchi; 1,867,506 issued July 12, 1932, to T. J. Grypma et al; 1,911,517 issued May 30, 1933, to D. Lanspa et al; and 3,271,792 issued Sept. 13, 1966, to G. M. Tromp.

Inspite of the above advances, there still exists today a need for a device suitable for use in water closets for the purpose of dispensing suitable coverings for water closet basin seats.

SUMMARY OF THE INVENTION

An object of the present invention is to provide a water closet basin assembly including means for dispensing suitable coverings for a water closet basin seat.

A further object of the invention is to provide such a device as will automatically dispense covering material.

A still further object of the invention is to provide such a device as is relatively simple in operation, easy to manufacture, and convenient and easy to use.

With the above and other objects in view, as will hereinafter appear, a feature of the present invention is the provision of a water closet basin assembly comprising a basin having an endless upper edge, a basin seat shaped complementarily to the edge and adapted to overlie the edge, bracket means fixed to the edge and having an elastomeric portion adapted to be disposed between the edge and the basin seat, the elastomeric portion being compressible when subjected to pressure and expandable to its original shape when the pressure is removed, and dispenser means proximate the basin and operative to dispense paper suitable for disposition overlying the closet, dispensing of the paper being responsive to movement of the elastomeric portion.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
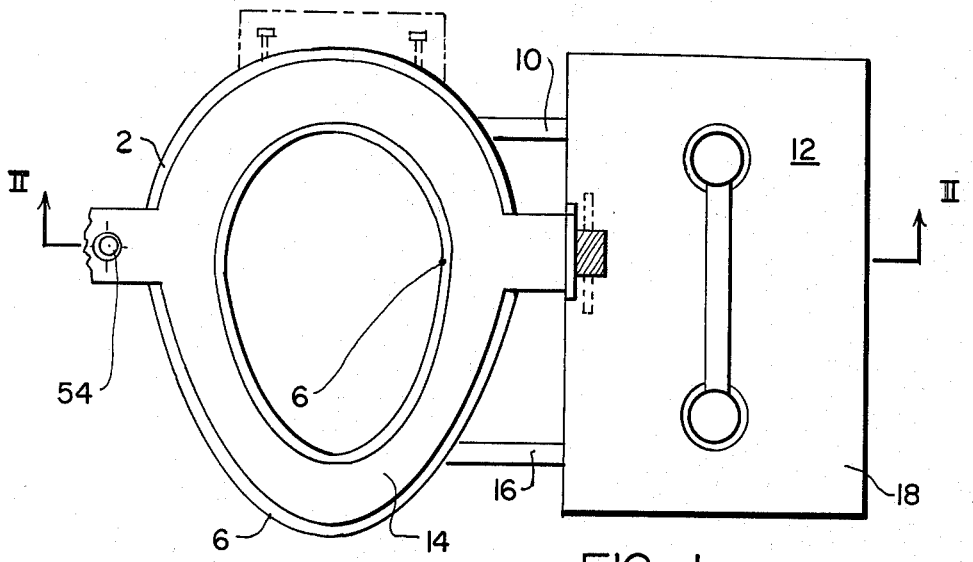
FIG. 1 is a top plan view of an illustrative embodiment of the assembly.

Referring to the drawings, it will be seen that the illustrative embodiment includes a water closet basin 2 having an endless upper edge 4. A basin seat 6 is provided shaped complementarily to the edge 4 and adapted to overlie the edge. The seat 6 is hingedly connected to the basin in the customary manner (not shown).

Figure 2:
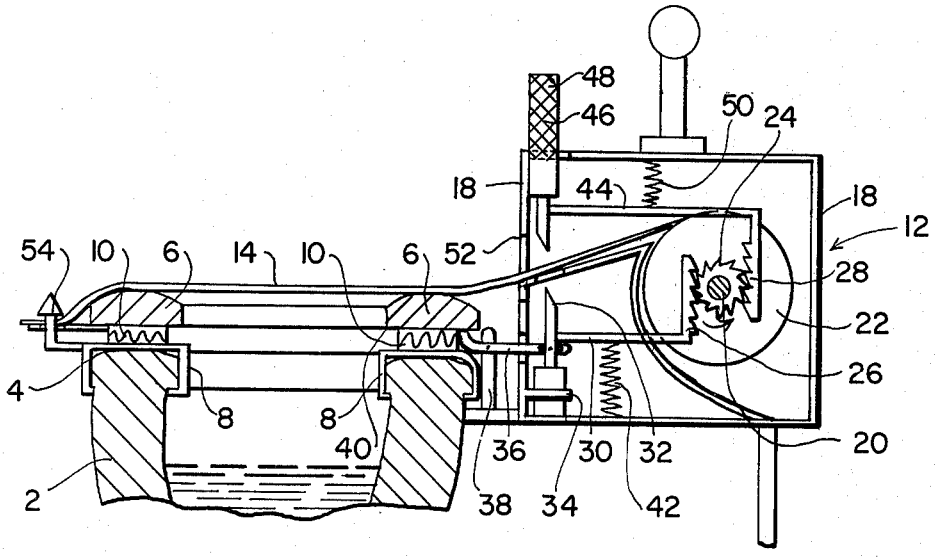
FIG. 2 is a sectional view taken along line II—II of FIG. 1.

Bracket means 8 are provided and are fixed to the edge 4 of the basin 2 and have affixed thereto an elastomeric portion 10, adapted to be disposed between the edge 4 and the seat 6, as shown in FIG. 2. The elastomeric portion is of material compressible when subjected to pressure and expandable to substantially its original shape when the pressure is removed. Thus, when weight is applied downwardly upon the upper surface of the basin seat 6, the elastomeric material 10 will be compressed, when the pressure is released from the seat 6 the material 10 will tend to return to its original shape.

Dispenser means 12 are provided proximate to the basin 2 and operative to dispense paper 14 previously cut to the general shape of the seat 6 and suitable to overlie the seat. As will be further described below, dispensing of the paper 14 by the dispensing means 12 is done in response to movement of the elastomeric material of the portion 10.

As may be seen in FIG. 1, the dispensing means 12 is connected to the basin 2 by way of frame means 16. Referring to FIG. 2, it will be seen that the dispensing means comprises a housing 18 having therein a spool 20 on which is mounted a roll 22 of the paper 14. On the spool 20 there is disposed a ratchet wheel 24 engaged with a first ratchet 26 and a second ratchet 28. The first ratchet 26 is connected by way of an arm 30 to a first cutter device 32 mounted for reciprocal movement in a bracket 34 extending inwardly from a side of the housing 18. The first cutter device 32 is pivotally connected to a lever arm 36 which is pivotally anchored by an extension 38 and which at its free end is in engagement with an undersurface 40 of the basin seat 6. A coil spring 42 operates to urge the arm 30 downwardly, as viewed in FIG. 2.

The second ratchet 28 is connected by way of an arm 44 to a second cutting device 46 having a handle 48 thereon for manual manipulation. A coil spring 50 operates to urge the arm 44 in an upwardly direction, as viewed in FIG. 2. Thus, pressure applied in a downward direction upon the upper surface of the seat 6 causes compression of the elastomeric material 10 which in turn causes pivotal movement of the lever arm 36 upon the extension 38 causing the first cutter device 32 to slide upwardly in its bracket 34 against the bias of the spring 42. Upward movement of the cutter device 32 causes severing of the paper 14 and also causes upward movement of the first ratchet 26. In view of the disposition of the teeth of the ratchet wheel 24 and the first ratchet 26, upward movement of the ratchet 26 does not operate to effect the wheel 24. When pressure is removed from the upper surface of the seat 6 the elastomeric portion 10 expands in an attempt to return to its original shape. Expansion of the material 10 causes the seat 6 to move upwardly allowing the spring 42 to bring the first cutter means 32 back to a non-cutting position and simultaneously to bring the ratchet 26 in a downwardly direction. Movement of the ratchet 26 in a downwardly position causes counterclockwise rotation of the ratchet wheel 24 and thereby the spool 20, as well as the roll of paper 22 to cause an increment of paper to be discharged through an opening 52 in the housing 18. In view of the disposition of the respective teeth, rotation of the ratchet wheel 24 has no effect upon the second ratchet means 28. Thus, the "old" paper is automatically severed and a new increment of paper issued from the dispenser upon use of the seat 6.

If desired, an operator may, by urging downwardly on the handle 48, operate the second cutter means 46, which is a manual cutting device. Downward movement of the cutting means 46 causes severance of the paper 14 and simultaneously causes downward movement of the arm 44 and the ratchet 28. Downward movement of the ratchet has no effect on the ratchet wheel 24 but does operate to retain the manual cutter 46 in the downward position until the ratchet wheel 24 is rotated counterclockwise by removal of pressure from the seat 6.

A holder means 54 is provided on a side of the basin 2 opposite from the dispenser 12. The holder means 54 may comprise any convenient means of fastening the paper 14 to the basin and preferably comprises merely an extension of the bracket means 8.

In use, the water closet seat may be envisioned as starting in the condition shown in FIG. 2. Application of pressure upon the seat 6 causes compression of the elastomeric material 10 and operation of the automatic cutting means 32, as above described. The pressure on the seat 6 also causes raising of the first ratchet means 26. In the event the second cutter means, or manual cutter means 46 has been previously used, the downward position of the second cutting means would be released by such action and the spring 50 would return the manual cutter to a position ready for operation. Removal of pressure from the seat 6 causes withdrawal of the cutting means 32 from the cutting position and rotation of the ratchet wheel 24 so as to dispense a new increment of paper which the operator would stretch across the seat and fasten down by use of the holder means 54, after first removing the old paper. Alternatively, the operator may utilize the manual cutter 46, as previously described.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. Water closet basin assembly comprising a basin having an endless upper edge, a basin seat shape complementarily to said edge and adapted to overlie said edge, bracket means fixed to said edge and having an elastomeric portion adapted to be disposed between said edge and said basin seat, said elastomeric portion being compressible when subjected to pressure and expandable to its original shape when said pressure is removed, and dispenser means proximate said basin and operative to dispense paper suitable for disposition overlying said seat, dispensing of said paper being responsive to movement of said elastomeric portion.

2. The invention according to claim 1 including cutter means for severing an increment of said paper dispensed from a roll thereof.

3. The invention according to claim 1 in which said dispenser includes a roll of said paper mounted on a spool, a sprocket wheel fixed to said spool, ratchet means engaged with said sprocket wheel, said ratchet means being movable by release of pressure on said seat means with consequent expansion of said elastomeric portion to cause movement of said sprocket wheel and thereby said spool, whereby to cause dispensing of said paper.

4. The invention according to claim 3 including cutter means for severing said dispensed paper, said cutter means being operative in response to application of pressure on said seat with consequent compression of said elastomeric portion to engage said dispensed paper and sever said paper from said spool.

5. The invention according to claim 4 in which said cutter means is spring biased toward a non-cutting position.

6. The invention according to claim 2 in which said cutter means comprises means operative responsive to pressure changes on said seat for automatically severing said increment of said paper.

7. The invention according to claim 2 in which said cutter means comprises manual cutter means.

8. The invention according to claim 1 in which said dispenser is mounted on a first side of said basin and including holder means mounted on a second side of said basin adapted to secure said paper in said overlying position.

9. The invention according to claim 4 including second cutter means manually operated to sever said paper, said second cutter means being connected to second ratchet means engaged with said sprocket wheel and operative after a manual cutting operation to cause rotation of said sprocket wheel and thereby said spool, whereby to cause dispensing of said paper.

10. The invention according to claim 8 in which said holder means comprises an extension of said bracket means.

* * * * *